US010441986B2

(12) United States Patent
Lattuada

(10) Patent No.: US 10,441,986 B2
(45) Date of Patent: Oct. 15, 2019

(54) METHOD FOR AUTOMATICALLY BENDING SPACER ELEMENTS FOR INSULATING GLASS PANES—DOUBLE GLAZINGS AND MACHINE FOR CARRYING OUT THE METHOD

(71) Applicant: LOMBARDA MACCHINE S.a.s. di G.B.Lattuada & C., Castano Primo (MI) (IT)

(72) Inventor: Giovan Battista Lattuada, Castano Primo (IT)

(73) Assignee: LOMBARDA MACCHINE S.R.L., Castano Primo (MI) (IT)

( * ) Notice: Subject to any disclaimer, the term of this patent is extended or adjusted under 35 U.S.C. 154(b) by 489 days.

(21) Appl. No.: 15/090,320

(22) Filed: Apr. 4, 2016

(65) Prior Publication Data

US 2016/0288185 A1 Oct. 6, 2016

(30) Foreign Application Priority Data

Apr. 2, 2015 (IT) ..... MI2015A0472

(51) Int. Cl.

| | |
|---|---|
| ***B21D 5/00*** | (2006.01) |
| ***B21D 7/16*** | (2006.01) |
| ***B21D 5/01*** | (2006.01) |
| ***B21D 7/12*** | (2006.01) |
| ***B21D 53/74*** | (2006.01) |
| ***E06B 3/663*** | (2006.01) |
| ***E06B 3/673*** | (2006.01) |

(52) U.S. Cl.

CPC ..... *B21D 7/162* (2013.01); *B21D 5/004* (2013.01); *B21D 5/008* (2013.01); *B21D 5/01* (2013.01); *B21D 7/12* (2013.01); *B21D 7/16* (2013.01); *B21D 53/74* (2013.01); *E06B 3/663* (2013.01); *E06B 3/6736* (2013.01); *E06B 3/67313* (2013.01)

(58) Field of Classification Search

CPC ..... B21D 5/002; B21D 5/004; B21D 5/008; B21D 5/02; B21D 7/162; B21D 7/02; B21D 7/024; B21D 11/22; B21D 37/16; B21D 53/74

See application file for complete search history.

(56) References Cited

U.S. PATENT DOCUMENTS

| | | | |
|---|---|---|---|
| 5,136,871 A | 8/1992 | Lisec | |
| 5,161,401 A | 11/1992 | Lisec | |
| 6,715,329 B1 | 4/2004 | Hametner | |

FOREIGN PATENT DOCUMENTS

| | | | |
|---|---|---|---|
| DE | 19839444 C1 * | 1/2000 | ..... B21D 7/162 |
| WO | 00/69726 A3 | 11/2000 | |

OTHER PUBLICATIONS

Italian Search Report and Written Opinion dated Dec. 3, 2015.

* cited by examiner

*Primary Examiner* — Debra Sullivan

(74) *Attorney, Agent, or Firm* — Hedman & Costigan, P.C.; James V. Costigan; Kathleen A. Costigan

(57) ABSTRACT

A computer controlled method for bending profiles for making insulating frames for double and triple glass pane glazings comprises at least the steps of: automatically feeding the profile to a profile machining section; immediately bringing the profile to a bending position, in which the profile is heated directly by hot air jets to a malleable condition at the bending position without moving the profile in its malleable condition.

7 Claims, 8 Drawing Sheets

Step 2: Heating

Step 3: Moving away the top heater arranging the self-centering punch and closing the gripper front jaw Step 3: Moving away the top heater arranging the self-centering forming punch and closing the gripper front jaw Step 6: Return of the bending paddle to the rest position Step 7: Unlocking the profile Step 7: Unlocking the profile

METHOD FOR AUTOMATICALLY BENDING SPACER ELEMENTS FOR INSULATING GLASS PANES—DOUBLE GLAZINGS AND MACHINE FOR CARRYING OUT THE METHOD

BACKGROUND OF THE INVENTION

The present invention relates, in a first aspect thereof, to a method for automatically bending spacer elements for insulating glass panes—double glazings.

In a second aspect thereof, the present invention relates to an automatic bending machine for carrying out the inventive method.

As is known, the first profile bending machines were introduced into the market about twenty years ago, both for meeting an increased demand of insulating glass panes or glazings, with double or triple glass sheets, and for improving and enhancing the assembling properties of the insulating glass panes, as well as for simplifying the operating personnel work while increasing the throughput.

Thus, from a technical standpoint, the insulating glass pane frames made in a profile bending machine, that is with their four corners bent instead of cut, have constituted a substantial improvement, since a bent angle or corner greatly improves the insulating capability of the inner double or triple glass sheet glazing, and since it prevents breaking regions from being generated in the frame.

In fact, the bent frames have four bent corners and a linear connector closing the open side.

At the glazing corners, which are the points more susceptible to leakages, the bent frame is less subjected to losses or leakages compared to a frame whose four corners or angles are closed by angular joint elements.

Prior profile bending machines carry out the bending process of the insulating pane inner spacer profiles or elements, which spacer profiles are generally made and sold as profile bars or rods having a length of five or six meters with a substantially rectangular cross section and two radiused beveled portions at the bottom part thereof, with a width which may vary from 6 mm to more than 30 mm, even if the most used widths vary from 8 to 24 mm, and with a height usually from 6.3 to 7 mm.

The above mentioned profile bars or rods comprise different materials, which may be generally classified into three material classes.

The most commonly sold bar-spacer elements, which may be processed in a much more simple and economic manner, are made of an aluminium material.

This type of material is the most diffused one on a worldwide level, even if it does not provide optimum results because of its comparatively small thermal insulating capability.

In the last decade, composite profiles have also been developed, consisting of a part of a stainless steel material and a part of a plastic material, which have progressively become more and more important, particularly on the Italian and European market.

The above profiles are the so-called "Warm Edge" profiles or spacer elements.

They provide an improved thermal insulation, because of their small contents of high thermal conductivity materials.

However, the structure of these materials results in a much more complex bending process.

In fact, even though their inner part is made of a plastic material, therefore it may be easily bent, their outer part is made of a steel material, therefore it has a much larger stiffness.

This fact involves that, in order to bend the outer steel structure, it is necessary to provide a very high bending force applied by the profile bending machine.

On the other hand, the plastic material reacts to the bending operation and tends to return to its starting position.

Moreover, to meet the current regulations, the enlargement of the profile at its bending point, with respect to its straight side, must not exceed 0.3 mm, and this also to be properly used in further processing operating steps.

Finally, it is very difficult to achieve a proper aesthetic quality of the inner bent portion, because of the above mentioned factors, which esthetic quality, on the other hand, is an essential aspect of the finished article of manufacture or frame, since such a finished frame will be visible inside the window or door frame/glazing, therefore it is very important to conceal to the view any defects susceptible to negatively affect the optical properties of the glazing.

The above mentioned factors have as a consequence that, compared to the aluminium profiles, the mentioned "Warm Edge" profiles are much more complex to be processed or machined, and only few prior bending profile machines are actually adapted to provide a proper bending thereof.

To the above it should be also added the fact that, in the last years, on the market have been also introduced some types of bars-profiles which, while being considered as belonging to the "Warm Edge" class, are differentiated from "Warm Edge" profiles both with respect to the thermal conductivity-composition thereof and their very complex machining/bending methods.

The above mentioned bars-profiles are made of composite extruded materials, usually a glass fiber and PVC material, in different rates, with an outer metal film applied on three sides.

This last type of material currently has the most useful operating performance in terms of a lower thermal conductivity, thereby providing the glazing made therefrom with an enhanced value.

However, because of the above mentioned properties, these materials cannot be bent by prior standard profile bending machines, since they must be necessarily subjected to a heating process of the part thereof to be bent, before the bending proper, and to a cooling of the bent section after bending, thereby they were usually considered as unbendable profiles and, for using them to form insulating glass pane frames, they were usually cut to size on the four frame sides, which were then closed by angular joint elements.

This process, even if it could be considered a proper one, involved an increased time requirement for making the related frame, and necessarily a forming of four breakage points at the four corners of the frame.

The working or processing mode of operation of prior profile bending machines, designed for bending only aluminium spacer elements and "Warm Edge" spacer elements which do not require any heating operation before bending, is generally rather similar for all the currently commercially available bending machines, which usually comprise an automated bending and related cutting system.

The bar profiles of a 5 or 6 m length are at first loaded in a bar storing arrangement which comprises a plurality of different operating sections to be used by an operator for loading the profiles to be processed.

More specifically, said profiles are automatically driven into the profile bending machine, where are performed all the process steps required for making the finished frame.

The entraining of the profile, and the measurement of the length necessary to provide the desired frame, are controlled by an encoder and position sensing photocell system.

In particular, after having fed the bar to be processed into the machining section, said bar is brought to a reference or "0" position, or, if necessary, the required "0" point is formed by a cutting operation.

Then, the bar is driven up to provide the desired length of the first side of the frame, which length will correspond to a preset part of the first side of the frame, since said first side will be practically split into two portions, and then it will be closed by a linear connecting arrangement at the end of the frame making operation.

At this time, the machine actuates a plurality of operating functions for performing a bending of the first frame angle or corner.

In particular, the profile is firmly engaged in a locking gripper, to prevent the profile from performing further movements; a forming assembly is arranged on the top part of the profile, for allowing the latter to be bent thereabove, while preventing any deformations of the inner part of the corner.

An automated raising or lifting paddle performs the bending operation by raising or lifting the profile part passed through the bending point in the profile positioning step, thereby providing a first side of the frame.

Upon ending the bending of the first frame angle or corner, the automated raising or lifting paddle will be downward displaced to achieve again the mentioned reference or "0" position; the top forming assembly will return again to its initial standby position, and the locking gripper will be opened to allow the profile to be driven away again.

Then, the bar driving system will be actuated again, to bring the profile or bar to a desired position suitable for bending the second frame angle or corner.

This method of operation will be continued so as to form the complete frame and the overall process will be ended by cutting the profile at the point thereof at which it should be closed by a linear connector to form a finished spacer element to be arranged inside the insulating glazing.

From the above it should be apparent that the bending system is the most important component of the bending machine, and, accordingly, it comprises a plurality of elements, that is a locking gripper; a top forming assembly and an automated bending paddle.

The top forming assembly, in most of prior profile bending machines, consists of a forming element depending on a size and type of the material being processed, therefore it must be replaced for each material changing or switching operation.

Accordingly, the prior bending cycle comprises three operating steps, that is: inserting the top forming assembly inside a gripper; closing the gripper to prevent the bar or profile from being deformed; and raising the bending paddle to bend that part of the profile which has passed through the gripper, and which will constitute a portion of the first side of the frame to be made.

The bending operation is performed with a 90° bending angle, and the profile is bent about the top forming assembly.

Such a bending process is a continuous one.

The measurement size and data related to the frames are set by the machine operator, or derived from optimizing programs and being then transferred to the profile bending machine to allow the latter to automatically perform the overall process.

Prior machines are designed for processing a profile at a time and, after having fully processed each profile, the same machine automatically performs a connection between the bar or profile being machined and the following one arranged in the storing arrangement.

Since the above mentioned "Warm Edge" profiles have structural features very different from aluminium profiles, the profile bending machine must be able to adjust a plurality of settings which are very critical for a proper achievement of the finished frame.

Vice versa, for bending the "Warm Edge" materials to be heated, the above disclosed method must comprise at least a heating step and a system for heating the profile at the section or portion thereof to be bent, as well as a cooling system for cooling the profile after the bending thereof.

Thus, even though bending machines adapted to bend "Warm Edge" profiles which must be heated are commercially available, these prior bending machines do not provide satisfactorily accurate and good aesthetic feature bending results.

In order to process "Warm Edge" materials which must be heated before bending, heating systems for heating the bars-profiles on line on the bending machine have been designed, and the bending machine has been equipped with further specifically designed auxiliary means, for allowing the machine to process the mentioned "Warm Edge" profiles to be heated.

However, a main drawback of the above mentioned prior bending machines, is that an operator cannot process a material which must not be heated and immediately afterwards process one which, on the contrary, must be heated and vice versa.

In fact, between the above two different processing operations, it is necessary to provide a rest period to allow the operator to assemble/disassemble the related proper auxiliary fittings.

Document WO00/69726 discloses a method and a device for forming a corner limited on three sides, from a plate-shaped material with an even surface.

In this prior method and device, the edges of a plate part which lie adjacent the corner are beveled along the main part of their longitudinal extension parallel to the even-surfaced plate part and have a curved outline in the area of the corner which is to be formed, from the beveled lateral edge to the plate of the even-surfaced plate. The curved transition area of the pre-formed blank is then pressed against an abutment tool and brought into contact with at least one zone of the assembly which overlaps the corner area between the lateral size. The corner is then produced by forming the material and is cut in a cutting device.

In this document the corner does not have two converging sides which define a precise 90° angle.

Moreover, this document neither discloses nor suggests to use air heating and cooling means for forming the corner.

Furthermore, this prior method and device are only adapted to process a plate-shaped material with an even surface, and the material is a sheet metal material. Stated otherwise, this prior method and device cannot machine all the materials machined by blowing hot and cold air at the corner region and, moreover, the corner region is not a perfect 90° corner region.

Document U.S. Pat. No. 5,136,871 A discloses a process and an apparatus for bending hollow profile strips into spacer frames for insulating glass panes. In this document, during the bending of a profile strip into a spacer frame for insulating glass panes, the strip is advanced, by a gripper, displaceable in the feeding direction of the hollow profile strip by predetermined distances to such an extent that the location of the profile strip to be bent in a particular case is aligned with respect to a bending abutment. During the bending process, performed by a bending lever, the profile strip is retained by the jaws of a bending head and the gripper moves back into its starting position. After the final advancement of the hollow profile strip, the latter is severed from the introduced profile strip and the final bending step is executed. The hollow profile strip is constantly retained during the production of the spacer frame either by the gripper or by the jaws of the bending head.

This document neither teaches nor suggests to blow heating and cooling air for forming the corner.

Moreover, this document does not provide corners with precise 90° bent angles.

Document U.S. Pat. No. 5,161,401 A discloses an apparatus for making continuously curved hollow profile strips, wherein the radii of curvature and the length of the curved or corner section of the profile strip can be selected extensively arbitrarily.

This latter document does not provide to use heating or cooling air blowing processes and, moreover, the corners of the frame produced thereby have not a precise 90° bending but, as stated, the corner have radii of curvature which can be selected extensively arbitrarily, but not including a precise 90° bent corner arrangement.

SUMMARY OF THE INVENTION

Accordingly, in order to overcome the above mentioned drawbacks of prior profile bending machines, the aim of the present invention is to provide a profile bending method and machine, controlled by a dedicated computer and a specifically designed computer program allowing to process all the above disclosed profile types, that is, in particular, aluminium profiles, "Warm Edge" profiles which must not be heated and "Warm Edge" profiles which must be heated, by a universal top forming assembly and a novel heating and cooling method and system specifically designed for the "Warm Edge" profiles to be heated.

Within the scope of the above mentioned aim, a main object of the present invention is to provide a bending profile method and machine which are structurally very simple and advantageous for the users, for greatly simplifying the work of the latter and for meeting the current requirements of improved profiles, made of materials which are increasingly difficult to be processed.

A further object of the present invention is to provide such a profile bending method and machine adapted to perfectly bend profiles at angles of 90°, with their inner part perfectly bent with a precise 90° angle, without any kind of bosses, and perfectly similar to a profile which would be cut and closed by an angular joint arrangement.

A further important object of the present invention is to provide such a profile bending method and machine, in which all the operating assemblies of the machine are directly "built-in" or embedded in the bending machine itself.

Yet another object of the present invention is to provide such a profile bending method and machine adapted to provide frames with three bent corners and an angular joint assembly which may be easily selected by an operator, for example a frame with four bent corners closed by a linear connecting arrangement, or a frame with three bent corners closed by an angular joint arrangement, which machine, owing to its specifically designed constructional features, is very reliable and safe in operation.

According to one aspect of the present invention, the above mentioned aim and objects, as well as yet other objects, which will become more apparent hereinafter, are achieved by a profile bending method and machine according to the enclosed claims.

BRIEF DESCRIPTION OF THE DRAWINGS

Further characteristics and advantages of the present invention will become more apparent hereinafter from the following detailed disclosure of preferred embodiments of the inventive method and machine, and with reference to the accompanying drawings, in which.

DESCRIPTION OF THE PREFERRED EMBODIMENTS

Figure 1:
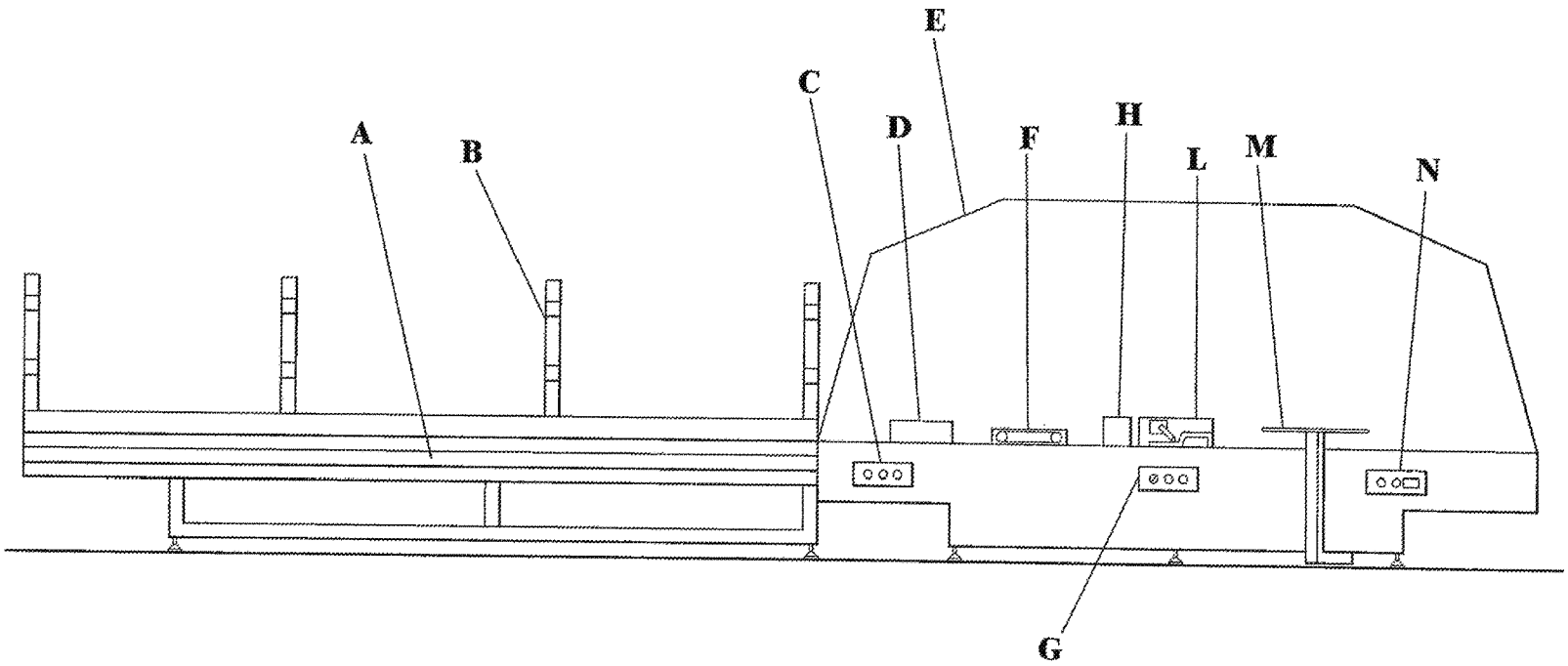
FIG. 1 is an overall view of the main arrangement of a preferred embodiment of the profile bending machine according to the present invention.

Before disclosing in a more detailed manner the preferred embodiments of the present invention, two prior solutions for processing "Warm Edge" profiles will be briefly disclosed.

The first solution is that of properly adapting or modifying a standard profile bending machine, that is to fit said machine to make it suitable for such a type of machining or processing.

The second solution, on the contrary, is to design a completely different machine, which does not perform a profile bending process, but an operating process for sealing or welding the corners of the sides of the frame which have been previously cut; this second solution does not relate to the present invention, since the inventive machine is actually related to a substantial improvement in the standard profile bending machine of the first solution.

In other words, the Applicant has improved, in an inventive manner, a generic machine of the first solution, in order to process "Warm Edge" materials which must not be heated as well as "Warm Edge" materials which must be heated, by providing a novel heating system for on line heating the profiles on the machine, and which has overcome all the above mentioned drawbacks of prior profile bending machines, and in particular the drawback that, in a prior machine, the operator cannot process a material which must not be heated and then bend a profile which must be heated and vice versa.

As stated, in a prior machine, between the two above mentioned operating modes of operation, a rest period must be provided for allowing the operator to assemble/disassemble machine fittings, whereas, in the inventive machine, according to a main aspect of the present invention, all the necessary devices are already installed or built-in on the machine itself.

In this connection it should be pointed out that, in the prior machine, the heating of the profiles is carried out by an electric resistance operating on a specific region of the material to be bent, thereby only a portion or section of the profile is heated, of about 1.5 cm, and, upon reaching the suitable temperature, the heated portion will be in a malleable condition, with a temperature generally from about 160° C. to 280° C.

Upon ending the heating of the portion or section to be bent to provide the first frame angle, the profile is displaced, i.e. it is brought to a position for performing the bending of the first angle, that is it is driven while it is in a malleable condition, thereby bending precision problems can occur.

Upon achieving the bending position, the following operating steps are substantially identical to those carried out for bending the profiles which must not be heated, and which have been already disclosed above.

With reference to the above mentioned figures, the present invention will be disclosed in a detailed manner with respect to a first preferred embodiment of the inventive profile bending machine, designed for bending both "Warm Edge" material which must not be heated and "Warm Edge" material which must be heated.

With reference to FIG. 1, is herein shown a general configuration of the bending machine according to the present invention.

In this figure, the reference letters show respectively:

A: a profile storing arrangement, preferably of a six position or compartment type; B: fixed structures for storing profile cartons or boxes; C: command panels for controlling the storing arrangement; D: an automatic profile joining section; E: a panel arrangement for supporting the profile being machined; F: an automatic profile driving system; G: a main panel for operating the machine and managing emergency conditions; H: a profile cutting system; L: an automatic profile heating/bending/cooling system; M: a machine managing "notebook" or "personal computer" support system; N: a panel for adjusting and controlling the machining temperature of the profiles to be heated.

Figure 2:
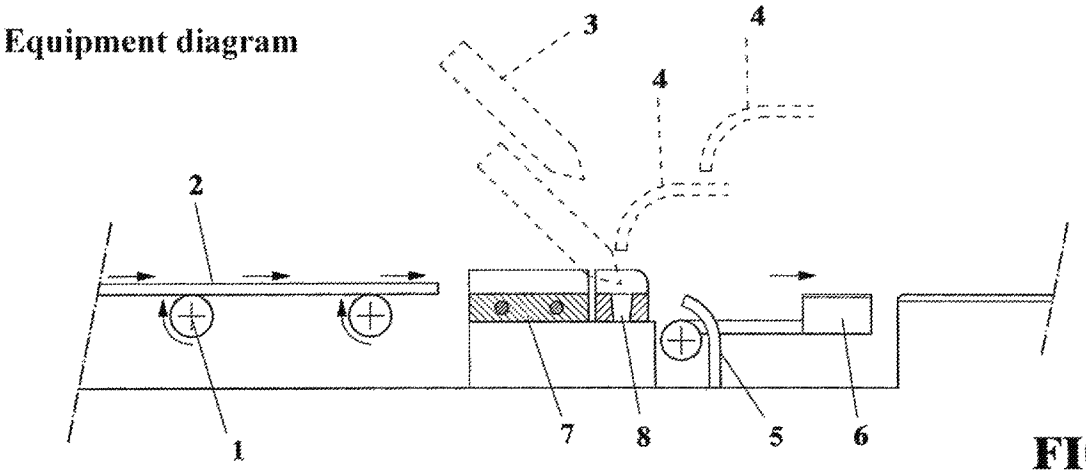
FIG. 2 is a schematic view illustrating, in a more detailed manner, a preferred embodiment of an automated profile heating, bending and cooling system included in the profile bending machine according to the present invention.

FIG. 2 schematically shows the equipment diagram of the inventive machine, that is, in particular, the automatic profile heating, bending and cooling system.

The reference numbers of FIG. 2 show the following components: 1: a profile support roller; 2: a profile being machined; 3: a self-adjusting top forming assembly with a built-in top cooling system; 4: a top heating system; 5: a bottom cooling system; 6: a profile raising/bending system (the profile raising or lifting paddle); 7: a gripper for the profile in bending position thereof (a=movable front position; b=fixed rear position); 8: a front heating system.

Figure 3:
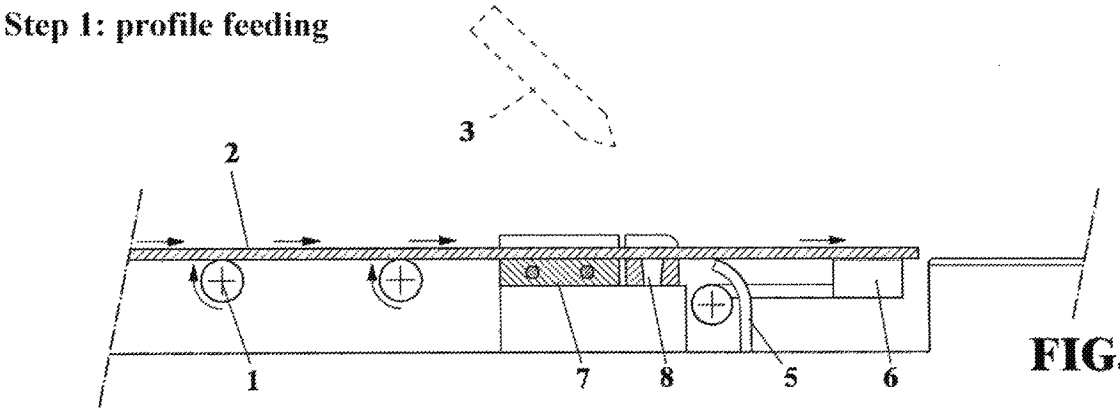
FIG. 3 shows a first operating step of the inventive method, that is the profile feeding step.

FIG. 3 shows the first profile 2 feeding operating step 1.

In FIG. 3, the reference number 1 shows the profile supporting rollers; 2: the profile being machined; 5: the bottom cooling system; 6: the profile raising/bending system (the profile raising paddle); 7: the gripper gripping the profile in its bending position (a=front position; b=rear fixed position).

The operating step 1 of the inventive bending method of FIG. 3 provides to feed the profile 2 up to reaching the proper bending position.

The profile 2, entrained on the supporting rollers 1, is driven up to allow the necessary length of the profile to pass through the bending point.

This will obviously depend on the final size of the frame to be made.

The profile is entrained or driven up to the point at which the section for forming the first angle or corner of the frame will be arranged in the bending zone.

The profile part exceeding the bending section will constitute a portion of the first side of the frame the length of which will correspond, as previously stated, to a preset part of the first frame side, since the first side will be split into two parts and accordingly will be closed by linear connectors at the end of the frame making operation.

Figure 4A:
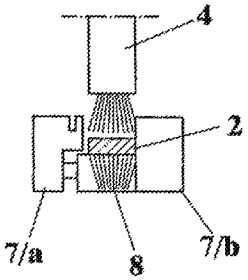
FIG. 4A is a view of FIG. 4 taken in the direction of the arrow A of FIG. 4.
Figure 4:
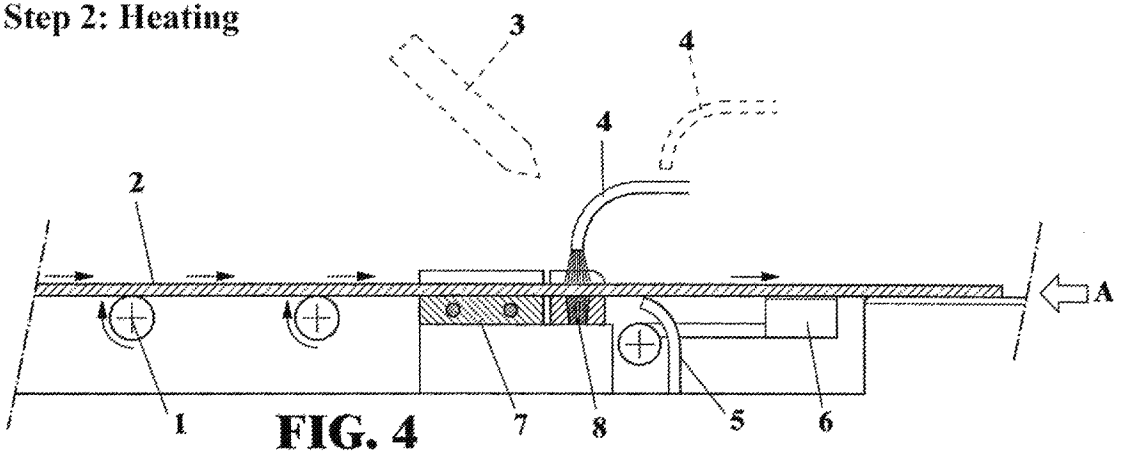
FIG. 4 shows the profile heating step.

In FIGS. 4 and 4A is shown a further second operating step of the inventive method, that is the heating step; the reference number 2 shows again the profile being machined; 4 the top heating system; 7 the profile gripper at a bending position (a=movable front position; b=fixed rear position); 8 the bottom heating system.

The above heating step provides to drive to a working position the top heating nozzle 4, which will be brought to a height of about 0.1/0.2 mm from the profile 2 with a start of the heating process by blowing in hot air, which is conveyed through the top nozzle 4 and through the bottom heating nozzle 8, thereby heating the profile in the respective top and bottom zones.

The heating of the profile 2 by hot air constitutes a main aspect of the present invention.

Figure 5:
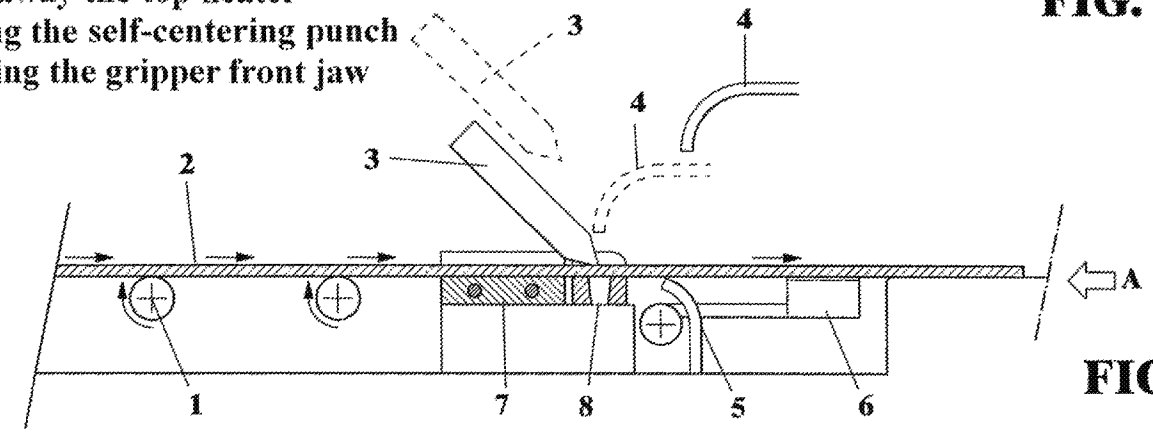
FIG. 5 is a schematic view showing an operating step for moving away the heating system and for properly positioning a self-centering forming punch element as well as closing a front jaw of a profile gripper.

FIG. 5 shows the operating steps for removing the top heater; arranging the self-centering forming punch and closing the gripper front jaw, which latter operating steps are also shown in FIGS. 5*a* to 5*d*.

In FIGS. 5 and 5*a* to 5*d*, the reference number 2 shows again the profile being machined; 3 the self-adjusting top forming assembly with the built-in top cooling system; 7 the gripper gripping the profile-bar at a bending position (a=front position, MO=movable front position; b=fixed rear position); 8 the bottom heating system.

At the end of the heating process, the hot air jets of the top and bottom heating systems are deactivated or switched off.

Then, a further operating step is started in which the top heater 4 is withdrawn while advancing the self-centering forming punch 3 to its working position.

FIGS. 5*a* to 5*d* represent in a detailed front view the movements related to the profile 3 self-centering mechanism and the profile locking in its bending position.

Figure 5A:
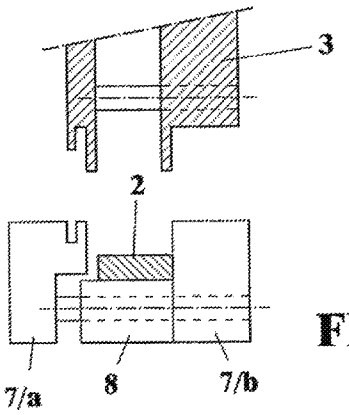
FIGS. 5*a* to 5*d* show further operating steps of the inventive method, that is starting from the rest position of the frame elements (FIG. 5*a*), a locating of a self-centering forming punch and a closing of the front jaw of the gripper (FIGS. 5*b* to 5*d*)

In particular, FIG. 5*a* shows the operating elements in a rest position thereof.

Figure 5B:
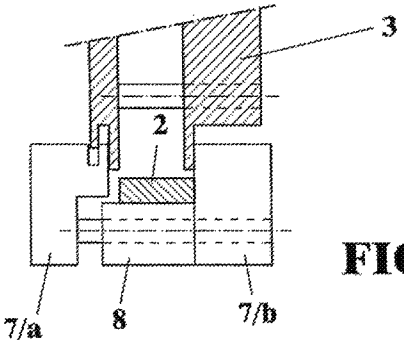

FIG. 5*b* shows that the self-centering forming punch 3 is driven to a middle position between the rest position and the working position to enter the jaws of the gripper 7.

Figure 5C:
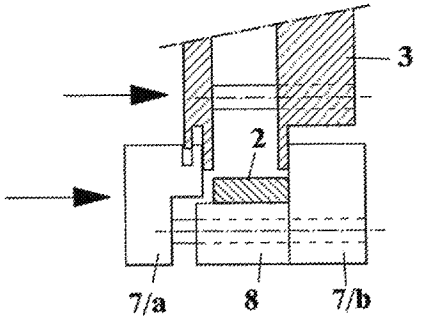

In FIG. 5*c*, the front movable jaw 7*a* of the gripper is displaced towards the rear jaw 7*b* so as to contact the profile 2, thereby pressing it against the rear jaw 7*b*.

At this time, the profile 2 will be clamped between the two gripper jaws 7*a* and 7*b*.

Owing to an interference between the self-centering forming punch 3 and front gripper 7*a*, the working position of the forming punch 3 will be also aligned.

Thus, the profile 2 will be horizontally locked and the forming punch 3 will be in such a position to be ready for vertically locking said profile.

Figure 5D:
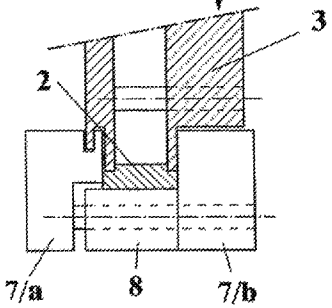

In FIG. 5*d*, the forming punch 3 is lowered so as to press the profile 2 against the support/bottom heating nozzle 8 which is fixed to the fixed jaw-gripper.

Figure 6:
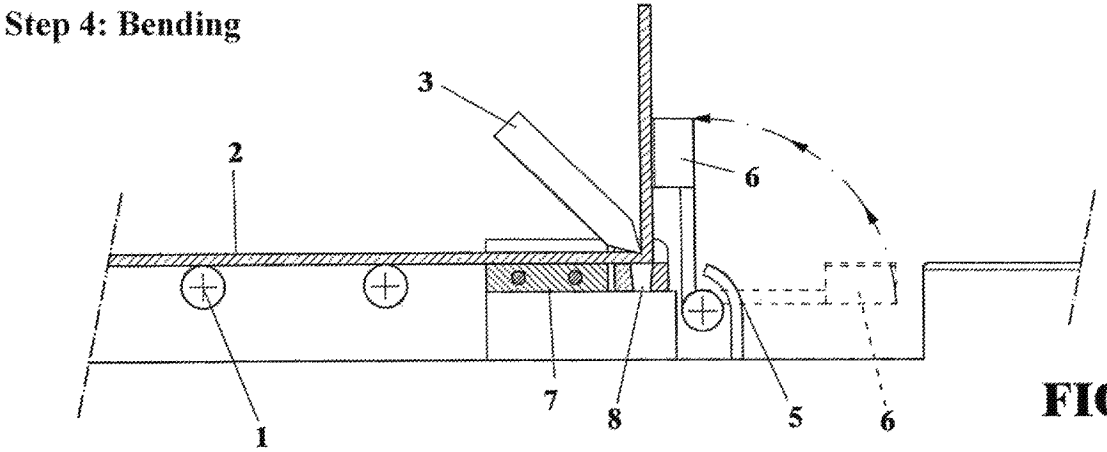
FIG. 6 is a further schematic view showing the profile bending operating step.

With reference to FIG. 6 is herein shown the profile 2 bending operating step.

In said FIG. 6, the reference number 2 shows again the profile being machined, whereas the reference number 6 shows the profile raising and bending paddle.

The profile 2, which has been heated and locked, is herein further heated as previously disclosed.

The profile bending is carried out by said bending paddle 6 which, at a rest position thereof, will constitute a portion of the profile sliding surface.

Thus, the paddle 6, by turning about a fulcrum, will apply to the profile 2 a force bending said profile precisely at a point which has been rendered malleable by heating, that is at the point coinciding with the center of the bottom heating nozzle 8.

According to the present invention, the bending of the profile 2 at the precise point at which the heating is performed (that is without any following movement to bring it to a bending position) constitutes a further main aspect of the Applicant's method and machine.

Figure 7:
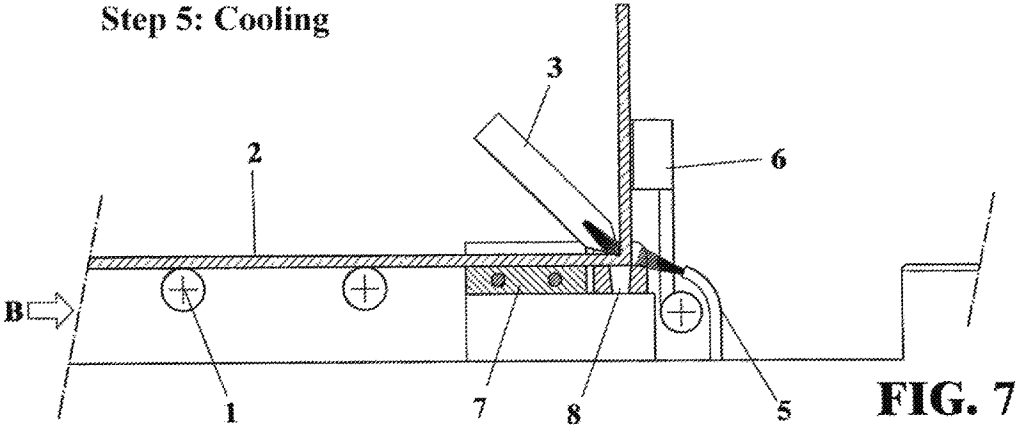
FIG. 7 is a further schematic view showing the bent profile cooling step.
Figure 7B:
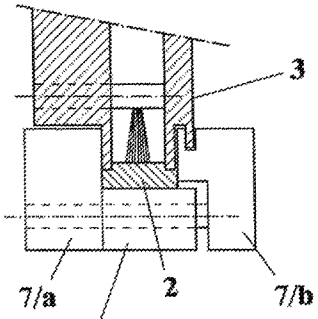
FIG. 7B is a side view of FIG. 7, substantially taken along the arrow B of FIG. 7.

With reference to FIG. 7, is herein shown the bent profile cooling operating step, FIG. 7B being a view taken substantially along the arrow B of FIG. 7.

In FIG. 7 the reference numbers show respectively: 2 the profile being machined; 3 the self-adjusting top forming assembly with the built-in top cooling system; 5 the bottom cooling system; 7 the profile gripper at a bending position thereof (a=movable front position, b=fixed rear position); 8 the bottom heating system.

In the cooling step 5, cooled air is blown on the bending point thereby making again rigid the just bent material; the blowing is performed through the cooling nozzle 5; the top punch 3 comprises therein an air distributing or delivering circuit (not shown) thereby holding the profile 2 locked also in the cooling step, and preventing said profile from being deformed.

Figure 8:
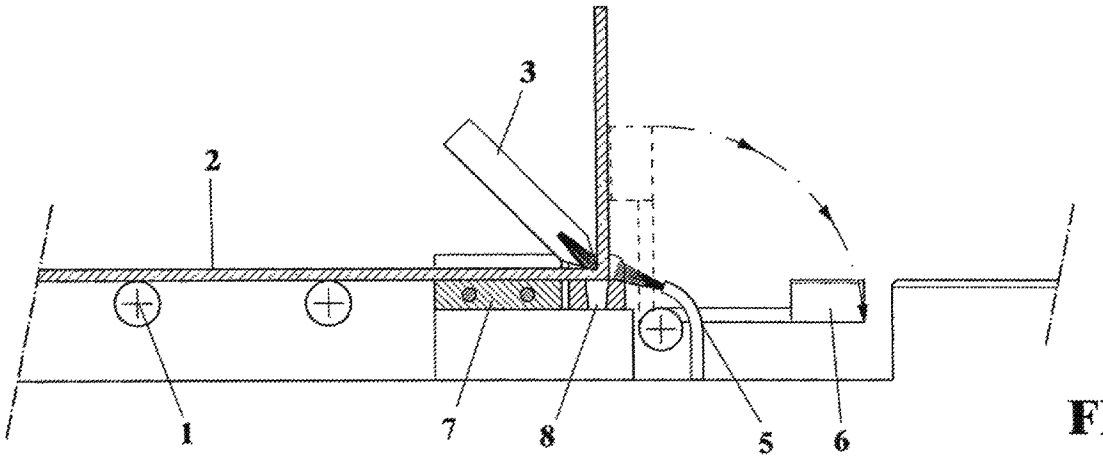
FIG. 8 shows an operating step in which the bending paddle returns to a rest position thereof.
Figure 8B:
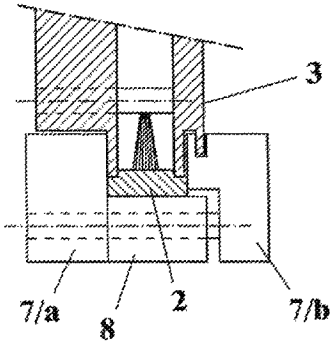
FIG. 8B is a side view of FIG. 8 substantially taken in the direction of the arrow B.

FIG. 8 shows an operating step in which the bending paddle returns to its rest position.

In FIG. 8, the reference numbers show: 2 the profile being machined; 3 the self-adjusting top forming assembly with the built-in top cooling system; 5 the bottom cooling system; 6 the profile raising/bending system (the profile raising paddle); 7 the profile gripper at a bending position (a=movable front position, b=fixed rear position); 8 the bottom heating system.

In this operating step, it is possible to see the return of the bending paddle 6 to its rest or standby position, whereas the cooling process is continued through the bottom cooling system 5".

In other words, after a suitable cooling period of time, sufficient to stabilize the profile, the bending paddle 6, which has previously bent the profile 2, is sent back to a standby or rest position, whereas the cooled air feeding is continued.

Finally, with reference to FIG. 9 and FIGS. 9*a* to 9*d*, are herein shown the profile disengaging operations or movements.

In said FIGS. 9 and 9*a* to 9*d*, the reference numbers show again: 2: the profile being machined; 3: the self-adjusting top forming assembly with the built-in top cooling system; 7: the profile gripper in a bending position (a=movable front position, b=fixed rear position); 8 the bottom heating system.

At the end of the profile 2 cooling step, the above disclosed elements will return to their rest positions and the profile 2 will be unlocked.

In the unlocking profile operating step, the forming punch 3, as shown, is moved away and, more specifically, the above disclosed operating steps are performed in a reversed order.

Figure 9:
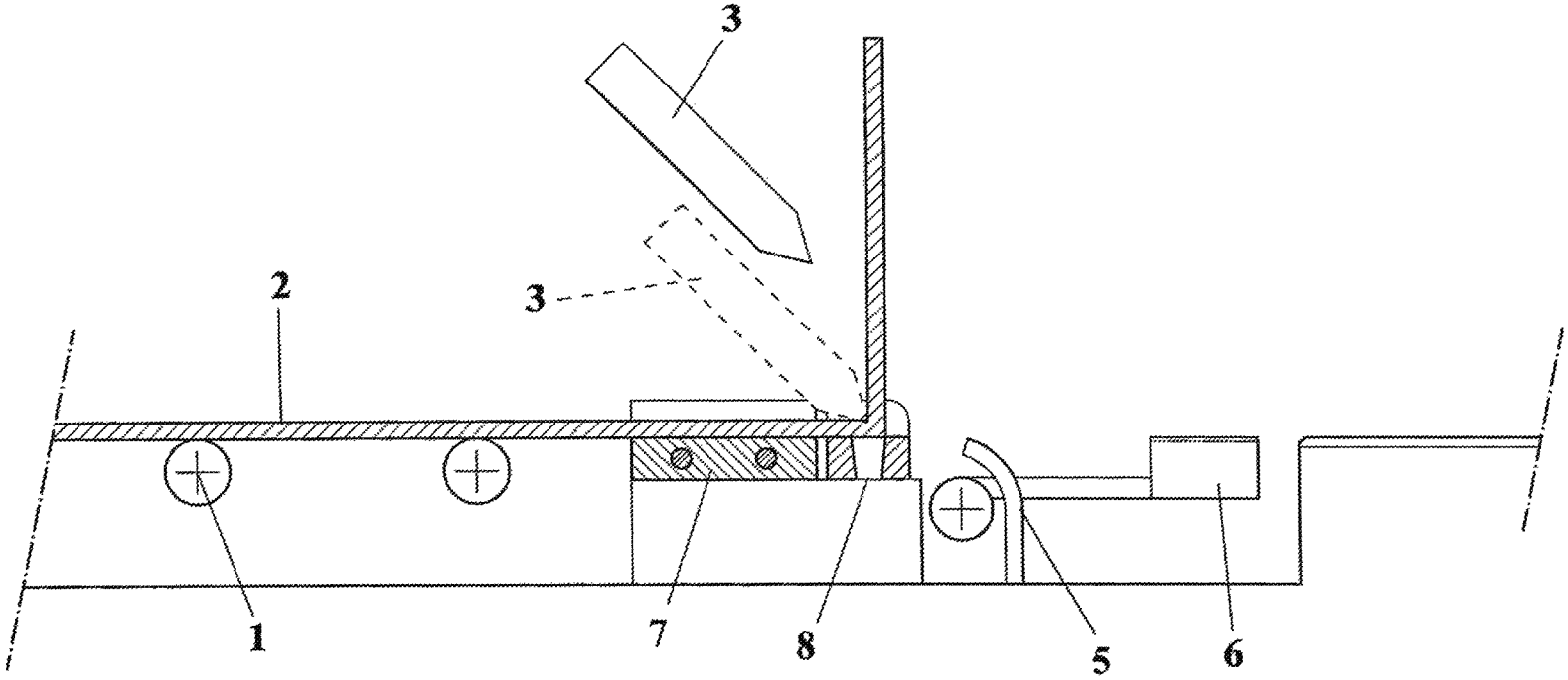
FIG. 9 shows an operating step for disengaging or unlocking the bent profile.
Figure 9A:
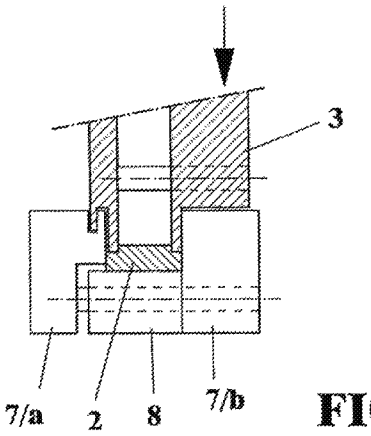
FIGS. 9*a* to 9*d* are detailed views of FIG. 9 substantially taken in the direction of the arrow A of FIG. 9.
Figure 9B:
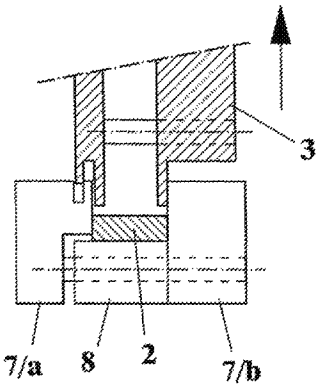
Figure 9C:
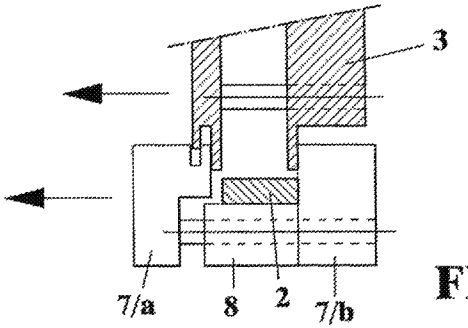
Figure 9D:
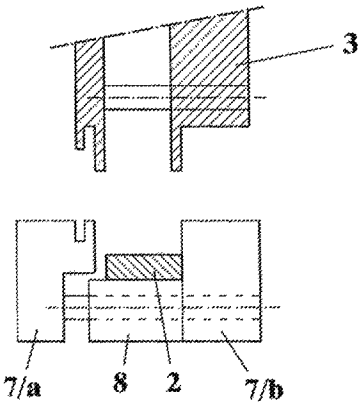

In the operating step of FIG. 9*a*, all the disclosed operating elements are still in their working position; in the operating step of FIG. 9*b*, a first partial withdrawing movement of the forming punch 3 is performed, and the outer part of the gripper, that is the front jaw, is moved away (7*c*), which movement will disengage the profile.

Owing to the interference between the self-centering forming punch and the front jaw, the forming punch itself will be spread apart, that is reopened.

This movement will disengage the profile 2, which then will be driven for performing the further operating steps.

In this connection it should be apparent that all the above disclosed operating steps will be controlled by a dedicated computer system, in turn controlled by a specifically designed software which, although not specifically shown, will come within the skills of one skilled in the art.

From the above disclosure it should be apparent that the present invention fully achieves the intended aim and objects.

In fact, the invention provides novel improvements in prior profile bending machines, in particular related to the self-adjusting top gripper-forming punch assembly and the related top heating system.

Moreover, the invention provides a bending system which allows to achieve profiles perfectly bent through 90°, with the inner part in a perfect 90° bent position, without bulgings and substantially similar to a cut profile closed by rectangular joining elements.

Although the invention has been disclosed with reference to a currently preferred embodiment thereof, it should be apparent that the disclosed preferred embodiment is susceptible to several modifications and variations, all of which will come within the inventive idea, a different arrangement, for example, of all the disclosed functional systems being possible in the same apparatus.

Thus, in evaluating the inventive improvements, the above disclosure should be considered by way of a merely indicative example, the scope of the invention being defined by the following claims.

The invention claimed is:

1. A computer controlled method for bending insulating glazing frame profiles, comprising at least the steps of:

providing an automated profile heating/bending/cooling system comprising: a self-adjusting top forming punch with a built-in top cooling system; a movable top heating system; a bottom cooling system; a profile raising/bending system; a movable locking gripper; and a bottom heating system;

automatically feeding said profile into a machining section of said automated profile heating/bending/cooling system and bringing said profile to a bending position and firmly locking said profile in said movable locking gripper in said bending position, heating to a malleable condition said profile firmly locked in said locking gripper by means of said top heating system so as to heat a top part of said profile and by means of said bottom heating system so as to heat a bottom part of said profile without moving said profile in said malleable condition in said bending position, said heating step comprising simultaneously heating said top part and said bottom part of said profile firmly locked in said locking gripper;

deactivating said top heating system and said bottom heating system and moving said top heating system to a withdrawn position and in the meanwhile moving said self-centering top forming punch to an operating position thereof engaged with said profile locked in said locking gripper engaged between a front jaw and a rear jaw of said locking gripper, bending said profile in said bending position by means of said profile raising/bending system with a precise 90° bending angle, with an inner part of said profile precisely arranged at said 90° angle, and cooling said precisely 90° bent profile simultaneously by means of said bottom cooling system to cool said bottom part of said profile and by means of said built-in top cooling system of said top forming punch arranged in said operating position engaged with said profile to cool said top part of said profile.

2. A method, according to claim 1, wherein said movable top heating system comprises top hot air jet nozzles which are withdrawable nozzles and said bottom heating system comprises bottom hot air jet nozzles which are fixed nozzles, said method comprising the steps of bringing said top nozzles to a heating position substantially coinciding with said bending position of said profile and moving away said top nozzles from said heating position to bring said top nozzles to a standby position at an end of said heating step.

3. A method, according to claim 2, wherein said method comprises displacing to said heating position said top hot air jet nozzles of said hot air heating system to a height of 0.1/0.2 mm from said top part of said profile; starting the heating of said heating step by blowing hot air through said top hot air jet nozzles and said bottom hot air jet nozzles of said bottom heating system, thereby heating said profile at said top and bottom parts of said profile; upon ending the heating deactivating the top and bottom hot air jet nozzles; withdrawing the top nozzle while simultaneously feeding or advancing said self-centering forming punch up to said operating position thereof, said self-centering forming punch being displaced to an intermediate position between a rest position thereof and a working position thereof to enter said front and rear jaws of said gripper locking said profile, the front jaw of said gripper being movably displaced toward the rear jaw to contact the profile by pressing said profile against the rear jaw, the profile being thus engaged between the front and rear gripper jaws and, by interference between said self-centering forming punch and front jaw, the forming punch being also aligned with respect to said operating position, thereby said profile is horizontally locked and said forming punch being ready for vertically locking, said forming punch being then moved downward to press the profile against the bottom nozzle fixed to a fixed jaw of said gripper, the heated and locked profile being then bent by a bending paddle element of said profile raising/bending system which, at a rest position thereof, constitutes a part of a profile sliding surface, said paddle rotating about a fulcrum thereby applying to said profile a force raising said profile up to 90° and precisely bending said profile at a point at which said profile has been made malleable by the top and bottom heating systems; said point substantially coinciding with a center of the bottom heating nozzle; the bent profile being then cooled by blowing cooled air jets on the bending point thereby making again rigid the just bent material, the cooled air being blown by at least a top cooling nozzle of said top cooling system embedded in said top forming punch and a dedicated bottom cooling nozzle of said bottom cooling system, the top forming punch including an air delivering circuit, thereby holding the profile locked also in a cooling step and preventing said profile from being deformed; said bending paddle, after having bent said profile, being brought back to a rest position thereof, while continuing a delivery of cooled air; at an end of the cooling step all said operating elements returning to a rest position and said profile being unlocked and said forming punch being moved away, thereby providing a first partial withdrawing movement of said forming punch and with the front gripper jaw moving away from the rear jaw up to an end of stroke position of this movement thereby disengaging the profile to allow said profile to be driven to further processing or machining steps, by an interference with said self-centering forming punch, said front jaw being further spread apart thereby releasing the forming punch, said forming punch being then upwardly driven again, thereby ending the profile machining operating cycle and a machining cycle being started repeating all the already performed operating steps for bending other three corners of said frame.

4. A method, according to claim 1, wherein in said step of automatically feeding said profile said profile is entrained on support rollers until a target length of said profile has passed through a bending point thereby a profile part exceeding the bending point thereof will form a portion of a first side of said frame.

5. A computer controlled apparatus for bending insulating glazing frame profiles comprising, all operatively interconnected on line in said apparatus:

a profile storing arrangement;

an automatic profile joining section;

a profile support panel arrangement;

an automatic profile driving system;

a profile cutting system;

an automated profile heating/bending/cooling system;

wherein said automated profile heating/bending/cooling system is built-in in said apparatus and comprises: a movable top heating system movably arrangeable in a heating position for heating a top part of said profile and a fixed bottom heating system arranged for heating a bottom part of said profile simultaneously with heating provided by said top heating system, thereby rendering a heated part of said profile malleable in a bending position of said profile, a movable locking gripper for removably locking the profiles in said bending position; a movable self-centering forming punch with an integrated top cooling system engageable with said profile locked in said bending position; and a profile raising/bending system for bending said profile locked in said bending position and having a width of substantially 8-24 mm, thereby allowing a material type or thickness to be changed without replacing parts of said apparatus; and a bottom cooling system, said punch being movably engageable in an operating position with said profile arranged in said bending position when said profile is locked in said bending position by said movable locking gripper and after said top heating system has been moved out of said heating position; said profile raising/bending system being movable to bend said profile 90° when said punch is engaged in said operating position with said profile locked in said bending position by said movable locking gripper, and said top cooling system and said bottom cooling system being activatable simultaneously after said profile has been bent 90° by said profile raising/bending system.

6. An apparatus, according to claim 5, further comprising a plurality of profile supporting rollers.

7. An apparatus, according to claim 5, wherein said profile raising/bending system comprises a bending paddle for bending through a precise 90° angle said profile, said paddle, at a rest position thereof, constituting a part of a sliding surface of said profile, said paddle being rotatable about a fulcrum to apply to said profile a bending force precisely at a point at which said profile has been made malleable by said top and bottom heating systems, said point coinciding with a center of a bottom heating nozzle of said fixed bottom heating system.

* * * * *